United States Patent [19]

Mayer

[11] Patent Number: 4,795,945

[45] Date of Patent: Jan. 3, 1989

[54] STARTING CIRCUIT FOR HIGH INTENSITY GASEOUS DISCHARGE LAMPS

[75] Inventor: Thomas J. Mayer, Hoffman Estates, Ill.

[73] Assignee: The Forest Electric Company, Melrose Park, Ill.

[21] Appl. No.: 47,903

[22] Filed: May 7, 1987

[51] Int. Cl.[4] ..... H05B 41/16

[52] U.S. Cl. ..... 315/276; 315/106; 315/177

[58] Field of Search ..... 315/106, DIG. 5, DIG. 2, 315/177, 276, 289, 290, 254

[56] References Cited

U.S. PATENT DOCUMENTS

| | | | |
|---|---|---|---|
| Re. 31,486 | 4/1979 | Helmuth | 315/205 |
| 3,732,460 | 5/1973 | Wattenbach | 315/DIG. 2 |
| 3,917,976 | 11/1975 | Nuckolls | 315/258 |
| 3,944,876 | 3/1976 | Helmuth | 315/205 |
| 4,132,925 | 1/1979 | Schmutzer et al. | 315/208 |
| 4,189,663 | 2/1980 | Schmutzer et al. | 315/205 |
| 4,213,076 | 7/1980 | Walz | 315/282 |
| 4,275,337 | 6/1981 | Knoble et al. | 315/289 |
| 4,410,837 | 10/1983 | Suzuki et al. | 315/DIG. 7 |
| 4,441,056 | 4/1984 | Siglock | 315/276 |

OTHER PUBLICATIONS

Excerpt from 1987 Catalog of Bag Turgi Electronic including cover page and pp. 68–70.

*Primary Examiner*—David K. Moore

*Attorney, Agent, or Firm*—Mann, McWilliams, Zummer & Sweeney

[57] ABSTRACT

A circuit for starting, operating and instant hot restarting of high intensity gaseous discharge lamps utilizes a conventional ballast, an ignition transformer and a pulse transformer. The ignition transformer is connected across the ballast output and is in circuit with a storage capacitor and a spark gap device which, in combination, provide high frequency, high voltage pulses to a pulse transformer which is in circuit with the high intensity gasesous discharge lamp. There are means to limit the duration during which the high frequency, high voltage pulses are applied to ignite the lamp and there is a current sensitive timing circuit breaker to protect the lamp and ignition circuit.

5 Claims, 1 Drawing Sheet

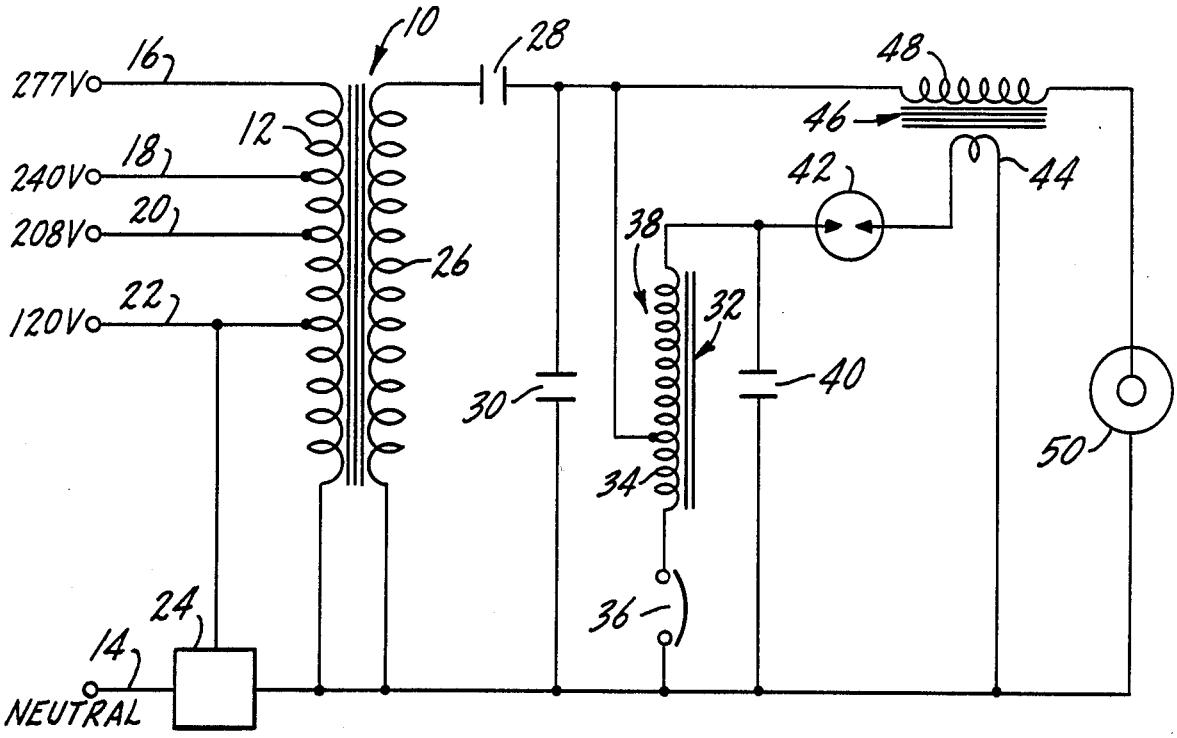
10
28
48
16
277V
12
46
18
240V
42
44
20
208V
38
26
22
120V
32
40
30
50
34
36
24
14
NEUTRAL

STARTING CIRCUIT FOR HIGH INTENSITY GASEOUS DISCHARGE LAMPS

SUMMARY OF THE INVENTION

The present invention relates to starting, operating and instant hot restarting circuits for high intensity gaseous discharge lamps and has particular application to such a circuit using a conventional ballast and a pulse transformer to provide high frequency, high voltage starting pulses for the lamp.

A primary purpose of the invention is a lamp starting and restarting circuit of the type described which provides an ignition circuit which consists of an ignition transformer, a storage capacitor and a spark gap device which, in combination, provide high frequency, high voltage pulses to a pulse transformer positioned in the lamp starting and operating circuit.

Another purpose is a starting and hot restarting circuit of the type described which includes pulse duration limiting means to protect the lamp ignition circuit.

Another purpose is a circuit for starting, operating and instant hot restarting of gaseous discharge lamps which includes current sensitive timing circuit breaker means to protect the lamp and starting circuit from malfunctions.

Another purpose is a simply constructed, reliably operable lamp circuit of the type described which uniquely combines a low power transformer, a spark gap ignition device and a storage capacitor to provide very high frequency, high voltage starting pulses for a high intensity gaseous discharge lamp.

Other purposes will appear in the ensuing specification, drawing and claims.

BRIEF DESCRIPTION OF THE DRAWING

The invention is illustrated diagrammatically in the attached schematic diagram illustrating a preferred form of the invention.

DESCRIPTION OF THE PRIOR ART

U.S. Pat. No. 4,189,663, dated Feb. 19, 1980 and assigned to the assignee of the present application, relates to direct current ballasting and starting circuitry for gaseous discharge lamps.

U.S. Pat. No. 4,132,925, dated Jan. 2, 1979 and assigned to the assignee of the present application, also relates to direct current ballasting and starting circuitry for gaseous discharge lamps.

U.S. Pat. No. 4,275,337 relates to a starting and operating circuit for gaseous discharge lamps utilizing a ballast reactor, pulse transformer and a voltage sensitive switch.

U.S. Pat. No. 3,944,876 and U.S. Pat. No. Re. 31,486 relate to a circuit for rapid starting of gaseous discharge lamps and uses a ballast transformer as well as several unidirectional semiconductor switching devices.

U.S. Pat. No. 4,213,076 relates to a constant current transformer for gas discharge tubes.

U.S. Pat. No. 3,917,976 relates to a starting and operating circuit for gaseous discharge lamps utilizing a ballast transformer and a neon glow tube as an ignition device.

Further, applicant is aware of the use of a spark gap device in an HID lamp circuit which has been manufactured in Switzerland by Bag Turgi Electronic and sold in the United States.

DESCRIPTION OF THE PREFERRED EMBODIMENT

High intensity gaseous discharge lamps such as high pressure sodium lamps, metal halide lamps and mercury vapor lamps require high voltage starting pulses for ignition when the lamp is cold and require substantially increased voltages and frequencies for hot restarting. The conventional cold starting circuits are not satisfactory to hot restart high intensity gaseous discharge (HID) lamps because they cannot provide the higher voltages and frequencies required for hot restarting. The present invention provides a lamp starting and hot restarting circuit which also functions effectively during normal lamp operation. It provides a conventional ballast transformer which is connected in series with a pulse transformer and the HID lamp. An injection or ignition transformer is connected across the output of the ballast transformer to substantially increase the ballast open circuit voltage, which voltage is stored in a capacitor connected to the ignition transformer secondary winding. The energy stored in the capacitor is injected into the primary winding of the pulse transformer when a spark gap device is ignited, creating voltages sufficiently high to overcome hot lamp capacitance and at a frequency high enough to insure rapid lamp restarting. Because the energy levels applied to the lamp at starting or restarting are quite high, provision is made to limit the time during which such high energy levels are present in the ignition circuit. Further, as soon as the ignition circuit is effective to start or restart the lamp, the ignition circuit is effectively removed from the lamp operating circuit by virtue of lowered ballast secondary voltage.

A ballast transformer is indicated at 10 and has a primary winding 12 which is connected to an AC source including a neutral line 14 and, on its hot side, a 277 volt input line 16. As illustrated in the drawings, there are other input lines, one at 240 volts, designated at 18; one at 208 volts, designated at 20; and one at 120 volts, designated at 22. This is merely to illustrate that the input of the ballast transformer may be at any particular voltage level, depending upon the type of HID lamp used in association with the lamp operating and starting circuit. An electronic circuit breaker is indicated at 24 and is connected between neutral line 14 and one of the input voltage lines. The circuit breaker 24 may be a current sensitive timing circuit breaker which trips or operates on either a lack of load, or underload, or on overload. Although the invention will be described in connection with a conventional ballast transformer, as illustrated in the drawing, it is equally applicable to a ballast transformer in which there is isolation between the primary and secondary windings.

Ballast transformer 10 has a secondary winding 26, one side of which is connected to a capacitor 28, which in turn is connected to a bypass capacitor 30, which is effectively connected across the secondary winding of the ballast transformer.

An ignition transformer 32 has its primary winding 34 connected across bypass capacitor 30 and in series with a bimetal circuit breaker 36. The secondary winding 38 of ignition transformer 32, which may, for example, be a 150 watt 2 amp transformer having a 3:1 turns ratio, is connected in parallel with a capacitor 40, one side of which is connected to a spark gap device 42 which may, for example, be a conventional spark plug. The spark gap device is sealed so that the oxygen therein is converted to ozone providing a constant firing potential. It functions as a voltage sensitive symmetrical switch and is particularly advantageous because of its rapid rise time. This device will conduct as soon as the breakover voltage is reached and the rise time is substantially faster than such conventional voltage sensitive switches as glow tubes, triacs, SCRs and other forms of solid state devices.

The output side of spark gap device 42 is connected to the primary winding 44 of a pulse transformer 46, with the other side of primary winding 44 being connected to capacitor 40. Thus, capacitor 40, spark gap device 42 and the primary winding 44 of pulse transformer 46, in combination, form an ignition circuit which will provide high energy pulses to the pulse transformer. The secondary winding 48 of pulse transformer 46 is connected between the ballast transformer 10 and HID lamp 50 which may be any one of the conventional lamps described herein.

An HID lamp of the type described, for example one rated at 1500 watts, will require approximately 1400 watts for starting and a voltage of approximately 100,000 volts is required for hot restarting, at a frequency of approximately 300,000 Hz or more.

In normal operation, and assuming either a cold or hot start, the open circuit voltage at the output side of ballast transformer 10 is applied across bypass capacitor 30 and hence is applied to the primary of ignition transformer 32. The circuit is designed to work with alternating current voltage and the voltage in the secondary of ignition transformer 32 will be applied to storage capacitor 40. As the 60 Hz applied sine wave increases in amplitude during its normal sinusoidal swings, the voltage applied to spark gap device 42 will read a level sufficient to cause ionization of the gases between its electrodes, with the result that this device will conduct and the energy stored in capacitor 40 will be rapidly discharged through the spark gap device and through the primary winding 44 of pulse transformer 46. Due to the exceptionally fast rise time of spark gap device 42, it is not necessary that capacitor 40 completely discharge before the charge and discharge cycle can be repeated. Thus, the frequency of the voltage pulses applied to primary winding 44 of the pulse transformer may be in the area of 300,000–1,000,000 Hz.

Because the pulse frequency is so high, transformer 46 may be quite small and still avoid overheating. The turns ratio between the primary and second windings of pulse transformer 46 is 24:1, with the result that the high frequency, high energy pulse applied at the primary winding of the pulse transformer will cause a substantially greater potential in the secondary winding and this pulse will be applied at the described frequency and at a voltage of approximately 100,000 volts to HID lamp 50. The frequency of application as described normally will result in a cold start or hot restart of the HID lamp. Because the energy applied by the pulse transformer secondary winding to the lamp is at a very substantial voltage level, it is necessary to have a bypass capacitor protecting the ballast transformer and this function is performed by capacitor 30. The pulsing of the lamp will continue until either the lamp is ionized or circuit breaker 36 is activated, opening the lamp ignition circuit.

Assuming ionization of lamp 50 prior to the time of activation of the circuit breaker, lamp 50 will draw a substantially higher current than that available during starting which will reduce the voltage across capacitor 30 at the output of the ballast transformer. Normally, the voltage during operation of the lamp is approximately one-third of the voltage at the ballast output during starting of the lamp. As a consequence of reduction of the output voltage across the ballast transformer, there will be similar reduction in the voltage applied to the ignition transformer, capacitor 40 and spark gap device 42. The voltage applied to spark gap device 42 during normal lamp operation is not sufficient to cause conduction. Thus, the ignition circuit is effectively deactivated and has no effect on normal lamp operation.

Due to the exceptionally high voltage levels required to restart a hot HID lamp, it is necessary to protect the pulse transformer, ignition transformer and the spark gap device or spark plug. The current required by the ignition transformer during normal operation is approximately one-eighth of that required during the starting cycle. Thus, circuit breaker 36 is chosen to hold at a current level sufficient to protect the device during normal operation. In the event of a prolonged starting cycle, for example exceeding one second, the application of current eight times the normal level to the circuit breaker for that period of time will cause the circuit breaker to open, thus deactivating the ignition circuit. As the bimetal circuit breaker cools, the ignition circuit will again be closed and the ignition cycle will be repeated. Should the HID lamp 50 fail to ionize within approximately four starting cycles of the circuit breaker 36, with each cycle being as described, then circuit breaker 24 will open which will shut down the lamp starting and operating circuit. The lamp and the starting circuit may then be inspected for malfunctions.

Circuit breaker 24 is current sensitive and is a timing type of circuit breaker which is effective to open either upon an overload or an underload. Thus, if the ignition circuit cycles through four attempts to start the lamp, without success, this will be viewed as an underload by circuit breaker 24 and it will open, permitting the described inspection.

Of importance in the invention is the use of relatively inexpensive and small sized transformers for the pulse transformer and the ignition transformer, but which components provide very high frequency and very high voltage starting energy for the lamp. The use of a spark gap device or a device having very rapid rise time, and one which does not have to have the applied voltage reduced to zero before it can be re-ionized, make it possible to use the described components.

Whereas the preferred form of the invention has been shown and described herein, it should be realized that there may be many modifications, substitutions and alterations thereto.

The embodiments of the invention in which an exclusive property or privelege is claimed are defined as follows:

1. A starting and operating circuit for a high intensity gaseous discharge lamp including:

a ballast transformer having its primary winding connected to a source of AC power, with the secondary winding thereof being connected in series with a high intensity gaseous discharge lamp, an ignition transformer having its primary winding connected in circuit with the secondary winding of said ballast transformer, a voltage sensitive, rapid rise time, symmetrical switch and a capacitor connected to the secondary winding of said ignition transformer, a pulse transformer having the primary winding thereof connected in circuit with said voltage sensitive switch and capacitor which provide high frequency, high energy pulses to said pulse transformer primary winding in accordance with conduction of said voltage sensitive switch, the secondary winding of said pulse transformer being in series circuit with said ballast transformer secondary winding and the lamp whereby a high energy pulse in the primary winding of said pulse transformer provides a lamp starting voltage in the secondary thereof, and a current limiting circuit breaker connected on one side to the lamp and on the other side to the primary winding of said ignition transformer.

2. The circuit of claim 1 further characterized in that said capacitor is connected across the secondary winding of said ignition transformer, with said voltage sensitive switch being connected between the primary winding of said pulse transformer and one side of said capacitor and ignition transformer secondary winding.

3. The circuit of claim 1 further characterized in that said voltage sensitive switch is a spark gap device.

4. The circuit of claim 1 further characterized by and including a bypass capacitor connected across the secondary winding of said ballast transformer to provide protection therefor during ignition of the lamp.

5. A starting and operating circuit for a high intensity gaseous discharge lamp including:

a ballast transformer having its primary winding connected to a source of AC power, with the secondary winding thereof being connected in series with a high intensity gaseous discharge lamp, an ignition transformer having its primary winding connected in circuit with the secondary winding of said ballast transformer, a voltage sensitive, rapid rise time, symmetrical switch and a capacitor connected to the secondary winding of said ignition transformer, a pulse transformer having the primary winding thereof connected on circuit with said voltage sensitive switch and capacitor which provide high frequency, high energy pulses to said pulse transformer primary winding in accordance with conduction of said voltage sensitive switch, the secondary winding of said pulse transformer being in series circuit with said ballast transformer secondary winding and the lamp whereby a high energy pulse in the primary winding of said pulse transformer provides a lamp starting voltage in the secondary thereof, and a current sensitive timing circuit breaker connected between the ballast transformer primary winding and one side of the source of AC power.

* * * * *